United States Patent [19]

Hartline, III

[11] 3,943,010

[45] Mar. 9, 1976

[54] PROCESS FOR PRODUCING AUSTENITIC FERROUS ALLOYS

[75] Inventor: Albert G. Hartline, III, Albany, N.Y.

[73] Assignee: Allegheny Ludlum Industries, Inc., Pittsburgh, Pa.

[22] Filed: June 12, 1974

[21] Appl. No.: 478,482

[52] U.S. Cl. ..... 148/31.5; 148/16.6; 148/39

[51] Int. Cl.[2] ..... C23C 11/16; C22C 38/04

[58] Field of Search ..... 148/12.1, 16.6, 31.5, 39; 75/126, 128

[56] References Cited

UNITED STATES PATENTS

| | | | |
|---|---|---|---|
| 1,207,848 | 12/1916 | Bray | 148/16.5 |
| 2,745,740 | 5/1956 | Jackson et al. | 75/126 B |
| 2,778,731 | 1/1957 | Carney | 75/126 B |
| 2,862,812 | 12/1958 | Dulis et al. | 75/126 B |
| 2,909,425 | 10/1959 | Hsiao et al. | 75/126 B |
| 2,940,880 | 6/1960 | Stanley et al. | 148/16.6 X |
| 3,854,938 | 12/1974 | Baybrook et al. | 75/128 W |

FOREIGN PATENTS OR APPLICATIONS

| | | | |
|---|---|---|---|
| 892,667 | 3/1962 | United Kingdom | 75/126 B |

*Primary Examiner*—C. Lovell

*Attorney, Agent, or Firm*—Vincent G. Gioia; Robert F. Dropkin

[57] ABSTRACT

There is disclosed a method for producing austenitic ferrous alloys containing from 21–45% manganese and from 10–30% chromium by exposing the alloys in solid form to nitrogen or nitrogen compounds at a temperature of at least 1700°F for a time period sufficient to raise the nitrogen content of at least the surface of the alloy to at least 0.85%.

3 Claims, 2 Drawing Figures

PROCESS FOR PRODUCING AUSTENITIC FERROUS ALLOYS

BACKGROUND OF THE INVENTION

Corrosion resistant steels, known as stainless steels, have long been known and are presently available with a variety of properties. Austenitic stainless steels, which are those consisting substantially of a single austenite phase, possess the best combination of corrosion resistance and good mechanical properties, particularly at high temperatures. Austenitic stainless steels in the past have been steels in which chromium and nickel are the principal alloying agents. However, nickel is not an abundant metal, and the increased demand for it has increased its price and made its supply uncertain, particularly in critical times. Substitutes for nickel in the chromium-nickel austenitic stainless steels have long been sought. Recently the combined use of manganese, nitrogen and chromium in carefully balanced amounts has produced an austenitic stainless steel. This steel is described in U.S. patent application Ser. No. 251,637, filed May 8, 1972.

Although the use of nitrogen, manganese and chromium in these stainless steels has produced excellent products, the production of such steels has not been without difficulty. Nitrogen escapes from molten metal as it cools, and it tends to come out of solution during solidification to produce porous ingots which are substantially useless. Particularly in slow cooling articles such as large castings with large cross sections, maintaining high levels of nitrogen in the steel is difficult; and obtaining useful, non-porous castings is correspondingly difficult. Nitrogen is a hardener so that high nitrogen steels are difficult to work. For some purposes a heterogeneous ingot structure may be desired even though it is more vulnerable to attack. In such cases an austenitic surface on the heterogeneous metal may be desired.

SUMMARY OF THE INVENTION

The present invention solves or greatly mitigates the above-mentioned problems. The present invention is a method for austenitizing a ferrous alloy containing from about 21–45% manganese and from about 10–30% chromium, by exposing solid forms of such ferrous alloys to nitrogen at a temperature of at least 1700°F and for a time period sufficient to raise the nitrogen content of at least the surface of the alloy to about 0.85%.

In the process of this invention, nitrogen apparently dissolves in the solid alloy surface and then diffuses into the body of the alloy. Surprisingly, nitrogen that diffuses into a solid alloy has the same effect on alloy structure as if it were dissolved in the molten alloy before it solidified. Thus, a heterogeneous alloy having a separate ferrite phase may be austenitized by being subjected to the process of this invention in that nitrogen entering through the surface of the alloy and diffusing into its body creates an austenitic phase where it is dissolved in quantities larger than 0.85% and less than 3.0%, and preferably between 1.05% and 1.5%. In this specification and the following claims, compositions stated in percent mean percent by weight of the total composition.

It is evident from the foregoing description that a nitrogen composition gradient throughout the body of the alloy may be obtained in accordance with this invention. Thus, an alloy that contains, for example, 0.5% nitrogen as a gross nitrogen composition may contain more than 1.0% nitrogen at its surface, thereby providing an austenitic, corrosion resistant surface for the alloy. It is also evident that the diffusion process provides an opportunity for reducing concentrations of nitrogen at the surface that are too high by heating the alloy to temperatures above 1700°F in the absence of nitrogen; whereby the nitrogen concentration in the alloy will be distributed more evenly across its entire cross section and will be correspondingly reduced at its surface. This may be necessary if the nitrogen content at the surface of the alloy becomes so high during processing that nitrides are precipitated.

In the process of the present invention, damaging temperatures must be avoided. For example, the solid alloys should not be maintained in the range of 1000°–1600°F for too long a time period to avoid the formation of sigma phase which deteriorates the mechanical properties of the alloy.

Alloys that may be benefited by the present invention are those that contain primarily chromium and manganese in addition to iron. However, such alloys may include copper, nickel, molybdenum, or any combinations of those elements to obtain special properties.

The alloys treated by the process of this invention must contain from 10–30% chromium. At least 10% chromium is required to give the steel its outstanding corrosion resistance. Chromium also has a secondary effect upon the strength of the steel and is a primary element in increasing the steel's solubility for nitrogen. An upper limit of 30% chromium is imposed as chromium above this level is a detriment to hot processing and increases the tendency toward formation of undesirable sigma phase. Ingots of this alloy containing more than 30% chromium have proven to be too brittle to hot work. A preferred chromium content is in the range of 15–27% in that steels containing this range of chromium are easy to produce while still having good corrosion resistance and strength.

The manganese in the alloy treated by the process of this invention is present in amounts from 21–45%. Since manganese is an austenitizer and increases the solubility of nitrogen in the steel, amounts in excess of 21% are required. An upper limit of 45% and preferably an upper limit of 30% manganese is imposed for economic considerations and because manganese tends to attack furnace refractories.

Nitrogen is a strong austenitizer and it is an object of the present invention to introduce it into the steel. At least 0.85% is required for its austenitizing effect and because it is the primary strengthening element of the steel. Amounts of nitrogen in excess of 3% tend to precipitate nitrides which reduce both the strength and corrosion resistance of the steel. The nitrogen content of the surface of alloys produced by the process of this invention preferably is from 1.05 to 1.5%.

Copper, nickel and molybdenum may be used in the alloy of this invention in amounts from 1–5% of molybdenum, 1–3% of copper, and 1–4% of nickel; or they may be used in combination in total amounts up to 5%. Copper and nickel improve the corrosion resistance of the alloy to dilute sulfuric acid, and molybdenum increases the amount of nitrogen that can be taken into the alloy.

Carbon is a well known austenitizer and strengthener and is employed in these alloys in amounts up to 1%. The alloys may tolerate silicon concentrations as high as 2%, but preferably the silicon content is maintained below 1%.

Although the residuals in iron need not be identified and do not significantly affect the properties of the alloy, the usual residuals may be identified as phosphorus, sulfur, tungsten and cobalt.

DETAILED DESCRIPTION OF THE INVENTION

To demonstrate the present invention, four alloys were melted having the compositions set forth in Table I.

TABLE I

| | Alloy No. | | | |
|---|---|---|---|---|
| | 1 | 2 | 3 | 4 |
| Manganese | 21.08 | 30.45 | 30.50 | 30.20 |
| Chromium | 26.26 | 19.98 | 20.15 | 20.03 |
| Copper | 0.09 | 0.20 | 1.02 | 0.21 |
| Molybdenum | 0.01 | 0.035 | 0.030 | 2.07 |
| Nickel | 0.23 | 1.07 | 0.22 | 0.23 |
| Nitrogen | 0.85 | 0.69(0.74)* | 0.65(0.67)* | 0.65(0.74)* |
| Carbon | 0.11 | 0.105 | 0.104 | 0.106 |
| Silicon | 0.35 | 0.45 | 0.50 | 0.56 |

*Nitrogen content after hot rolling

All of the alloys shown in Table I were prepared in the same way. All alloys were melted in an air induction furnace and were composed of commercial grades of ferroalloys and pure elements. The alloys were cast from approximately 2650°F into 35 pound cast iron ingot molds. After solidification, the ingots were examined for porosity which was not observed in any of the alloys because of the low nitrogen content. Hot processing consisted of rolling the ingots after an appropriate soak time at 2250°F. The alloys were subsequently annealed on a schedule of 120 minutes per inch of thickness at 1950°F and cleaned. A 50% cold reduction was given to all alloys prior to nitrogen annealing.

The nitrogen annealing was performed at the temperatures and for the time periods indicated in Table II. Temperatures above 1800°F were employed in all cases to avoid the formation of sigma phase which has a detrimental effect on the alloys. The nitrogen annealing was effected in an atmosphere of commercially pure nitrogen. However, following the nitrogen annealing, a slight oxide coating was found on the alloys. Table II shows the nitrogen content of the alloys after periods of treatment at different temperatures. It should be noted that Table II reports the nitrogen content as that of the bulk material. The nitrogen concentration in the alloys treated as set forth above will be graduated from the surface toward the interior of the solid alloy being treated. Accordingly, the nitrogen content at the surface of the alloys will be higher in almost all cases than the nitrogen content toward the middle. Since nitrogen diffuses into the alloy, the nitrogen content in the interior portions of each alloy will be higher as the nitrogen annealing time increases. To investigate the effectiveness of nitrogen annealing, one specimen of each alloy was soaked in nitrogen at 1900°F for 114 hours, which was a substantially longer soak period than the other specimens were subjected to. For this long-term period, the diffusion processes had sufficient time so that it is likely that those alloy specimens were close to being homogeneous.

TABLE II

| | | % Nitrogen After Nitrogen Treatment | | | |
|---|---|---|---|---|---|
| Temp. (°F) | Time (min.) | 1 | 2 | 3 | 4 |
| 1800 | 0 | 0.850 | 0.740 | 0.670 | 0.740 |
| | 5 | 1.02 | 0.788 | 0.771 | 0.790 |
| | 10 | 1.02 | 0.774 | 0.781 | 1.02 |
| | 15 | 1.01 | 0.783 | 0.762 | 1.08 |
| 1900 | 5 | 1.01 | 0.787 | 0.752 | 0.809 |
| | 10 | 1.03 | 0.804 | 0.793 | 1.10 |
| | 15 | 1.06 | 0.993 | 0.860 | 1.01 |
| | 114 (hours) | 3.21 | 3.07 | 3.17 | 2.11 |
| 2000 | 5 | 1.09 | 0.829 | 0.818 | 0.843 |
| | 10 | 1.02 | 0.842 | 0.790 | 0.860 |
| | 15 | 1.10 | 0.950 | 0.872 | 0.882 |
| 2100 | 5 | 1.02 | 0.830 | 0.787 | 0.857 |
| | 10 | 1.23 | 1.18 | 0.799 | 0.872 |
| | 15 | 1.15 | 0.915 | 0.972 | 0.920 |

It may be noted from Table II that the nitrogen content of all of Alloys 1–4 inclusive is increased by relatively brief periods of treatment in the range of temperatures from 1800°–2100°F. Of particular interest is Alloy 4. The high molybdenum content of Alloy 4 apparently increases its ability to take on nitrogen from the atmosphere; and, additionally, it appears to moderate the absorption of nitrogen so that too much is not dissolved. Accordingly, for alloys to be austenitized by annealing in the presence of nitrogen, it is particularly advantageous to include molybdenum in excess of 1% in the alloy composition.

The accompanying figures are presented to further illustrate the process of the present invention.

Figure 1:
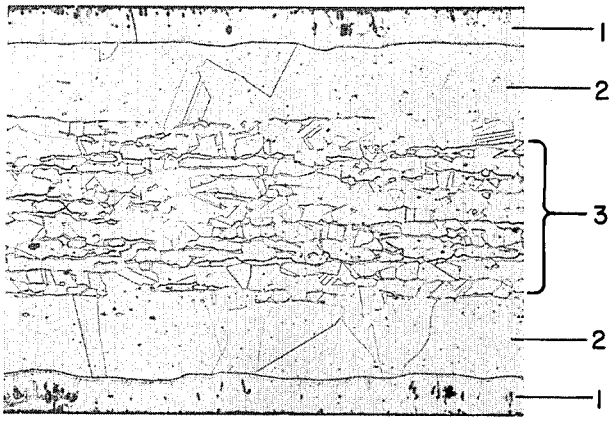
FIG. 1 is a photomicrograph of a specimen of Alloy 1 after it was annealed in air at a temperature of 2350°F for a period of 15 minutes.

Referring to FIG. 1, three distinct zones of the cross section may be discerned. Starting from the outside surface and working toward the center, zone 1 is an oxide layer that terminates in a rather abrupt line. Beneath the oxide layer is an austenitic phase 2 that was austenitized by absorption of nitrogen from the atmosphere in which the nitrogen annealing was effected. The center zone 3 is a two-phase system of austenite and ferrite. Further nitrogen absorption from the atmosphere or further diffusion of nitrogen would increase the depth of the austenitic zone and diminish the thickness of the two-phase austenite-ferrite zone until eventually the entire cross section of Alloy 1 would be austenitic.

Figure 2:
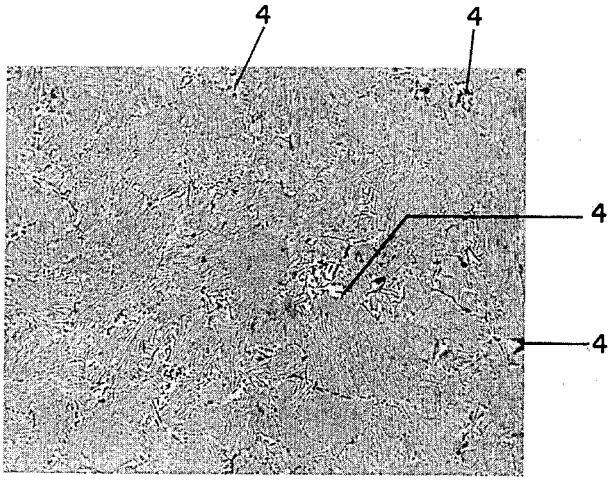
FIG. 2 is a photomicrograph of a specimen of Alloy 2 after it was annealed in nitrogen at a temperature of 1900°F for a period of 114 hours.

Referring to FIG. 2, the alloy shown in the photomicrograph contains 3.07% nitrogen; and, as may be seen from the photomicrograph, a two-phase structure including precipitated nitrides of alloying elements has formed thereby indicating that a nitrogen content in excess of 3% causes the formation of undesirable phases. Some precipitated nitrides are indicated in FIG. 2 at 4.

From FIG. 1 and FIG. 2 it is evident that a great deal of control may be exercised by suitably adjusting nitrogen treating times and conditions. For example, when it is desired to have a completely austenitized cross section, it may be required to anneal in nitrogen for a long period of time to introduce high concentrations of nitrogen, but less than 3%, into the surface of the alloy — after which annealing in a neutral atmosphere such as argon may be performed for a time sufficient for the nitrogen at the surface of the alloy to diffuse toward the center, thereby austenitizing the center of the cross section and diminishing the concentration of nitrogen at the surface. The diffusion period may be followed by further nitriding if a higher concentration of nitrogen is again desired at the surface. It is evident that experience with a given alloy will quickly establish guide lines for times, temperatures, and other conditions of treatment. It is also evident that alloy shapes with thin cross sections, such as thin sheets, can be austenitized across their entire cross sections more quickly than thicker shapes.

Another variation in the process of the present invention is effecting nitriding of the surface very locally. This can be accomplished by treating the surface, for example of a very large casting that would not fit in an ordinary annealing oven, by heating the surface to a temperature in excess of 1700°F with a flame that includes nitrogen. Such a flame preferably is one that employs air as a gas to support combustion and is regulated with regard to the air-fuel mixture so that the resulting combustion gas is a reducing gas containing a high concentration of nitrogen.

The nitrogen employed in the process of the present invention may be elemental nitrogen or a suitable nitrogen compound. Treatments effected by annealing the alloys of this invention in contact with ammonia, amines, or other sources of nitrogen are also effective. The various nitrogen compounds are not necessarily equivalent to each other having in general, atmospheres providing a high partial pressure of nitrogen may be suitable.

One of the major benefits obtained by increasing the nitrogen concentration at the surface of the alloys useful in this invention is that the high nitrogen concentration produces a one-phase austenitic structure which is highly resistant to chloride pitting. Chloride pitting is usually measured by a potentiokinetic technique. In this technique, an alloy specimen is placed in contact with an appropriate chloride solution, and an electrical potential is imposed on the specimen at increasing voltage until a breakthrough point is reached at which a surge of current passes through the solution. Higher breakthrough potentials indicate greater resistance to chloride pitting. In the alloys of this invention, a direct correlation was observed between breakthrough potential and nitrogen concentration at all nitrogen levels below 3.0%. This correlation can be best demonstrated by the data accumulated in testing various specimens of Alloy 2. Table III reports these data.

TABLE III

| Temperature (°F) | Time (min.) | Nitrogen Content | Breakthrough Potential (volts) |
|---|---|---|---|
| 1800 | 15 | 0.783 | 0.93 |
| 1900 | 15 | 0.993 | 1.22 |
| 2000 | 15 | 0.950 | 1.35 |
| 2100 | 15 | 0.915 | 1.27 |
| 1900 | 144 hours | 3.07 | −0.26 |

It may be seen from Table III that the nitrogen content of the alloy specimens is directly related to the resistance to chloride pitting as measured by the potentiokinetic technique. It may be noted that the resistance to chloride pitting diminishes drastically when a two-phase system exists as indicated by the specimen treated for 144 hours having a gross nitrogen content of 3.07 which displayed a negative breakthrough potential. The specimen reported there is the specimen illustrated in the photomicrograph of FIG. 2.

In summary, the process of the present invention provides a method for producing alloys having a high nitrogen content without the usual problems associated with making such alloys, such a the production of porous ingots due to nitrogen coming out of solution when a high nitrogen content alloy is solidified. The process of the present invention additionally provides a producer the opportunity to adjust the nitrogen content of an alloy if analysis after the alloy is cast indicates that the nitrogen content is lower than desired. The process of the present invention additionally permits the production of articles having nitrogen concentration gradients across their cross section so that an alloy article may be produced having high corrosion resistance at its surface without affecting the mechanical properties of the alloy across its entire cross section.

I claim:

1. An article of manufacture comprising a solid ferrous alloy consisting essentially of from about 21–45% manganese, from about 10–30% chromium, balance essentially iron, and having at its surface from about 0.85–3% nitrogen with a lesser nitrogen content in its interior than at its surface, said article having an austenitic surface and a two phase interior of austenitic and ferrite.

2. An article according to claim 1 wherein said alloy additionally contains at least one metal from the group consisting of 1–5% molybdenum, 1–4% nickel and 1–3% copper, and wherein said alloy, when two or more said metals are present, does not exceed 5% total thereof.

3. An article of manufacture comprising a solid ferrous alloy consisting essentially of from about 21–45% manganese, from about 10–30% chromium, balance essentially iron, and at its surface from about 0.85–3% nitrogen — said article having an austenitic surface and a two-phase interior comprising austenite and ferrite.

* * * * *